US011592033B2

(12) United States Patent
Garcia et al.

(10) Patent No.: US 11,592,033 B2
(45) Date of Patent: Feb. 28, 2023

(54) PUMP ASSEMBLY AND RELATED METHODS

(71) Applicant: Wayne/Scott Fetzer Company, Westlake, OH (US)

(72) Inventors: Michael Steven Garcia, Harrison, OH (US); Philip Anthony Mayleben, Burlington, KY (US); Nicholas Steven Hafele, Cincinnati, OH (US)

(73) Assignee: Wayne/Scott Fetzer Company, Westlake, OH (US)

( * ) Notice: Subject to any disclaimer, the term of this patent is extended or adjusted under 35 U.S.C. 154(b) by 0 days.

(21) Appl. No.: 17/037,977

(22) Filed: Sep. 30, 2020

(65) Prior Publication Data

US 2021/0095694 A1 Apr. 1, 2021

Related U.S. Application Data

(60) Provisional application No. 63/085,031, filed on Sep. 29, 2020, provisional application No. 62/908,458, filed on Sep. 30, 2019.

(51) Int. Cl.
*F04D 29/42* (2006.01)
*F04D 13/08* (2006.01)
(Continued)

(52) U.S. Cl.
CPC ..... *F04D 29/4293* (2013.01); *F04D 13/08* (2013.01); *F04D 13/086* (2013.01);
(Continued)

(58) Field of Classification Search
CPC .. F04D 13/086; F04D 15/0218; F04D 29/708; F04D 29/445; F04D 13/08;
(Continued)

(56) References Cited

U.S. PATENT DOCUMENTS 2,333,243 A 11/1943 Glab
2,553,066 A 5/1951 Southern
(Continued)

FOREIGN PATENT DOCUMENTS

CN 203548187 4/2014
CN 201330537433 6/2014
(Continued)

OTHER PUBLICATIONS

Wikipedia, Redundancy (engineering), 2016.
(Continued)

*Primary Examiner* — Peter J Bertheaud
(74) *Attorney, Agent, or Firm* — Fitch, Even, Tabin & Flannery LLP

(57) ABSTRACT

In one aspect, a pump is provided comprising a motor configured to rotate a shaft that is operably coupled to an impeller. The impeller is housed within a fluid chamber having an inlet and a discharge in fluid communication with the inlet. The fluid chamber further includes an outlet in a top portion thereof for venting air within the fluid chamber when the impeller is rotated by the motor. In other forms, a pump assembly is provided with an internal float switch integrated into the pump housing.

10 Claims, 17 Drawing Sheets

(51) Int. Cl.

| | |
|---|---|
| ***F04D 29/70*** | (2006.01) |
| ***F04D 29/22*** | (2006.01) |
| ***F04D 29/043*** | (2006.01) |
| ***F04D 15/02*** | (2006.01) |
| ***F04D 29/66*** | (2006.01) |
| ***F04D 29/44*** | (2006.01) |
| ***F04D 15/00*** | (2006.01) |

(52) U.S. Cl.
CPC ..... *F04D 15/0088* (2013.01); *F04D 15/0218* (2013.01); *F04D 29/043* (2013.01); *F04D 29/22* (2013.01); *F04D 29/426* (2013.01); *F04D 29/445* (2013.01); *F04D 29/669* (2013.01); *F04D 29/708* (2013.01)

(58) Field of Classification Search
CPC ..... F04D 15/0088; F04D 29/4293; F04D 29/426; F04D 29/669; F04D 29/043; F04D 29/22
See application file for complete search history.

(56) References Cited

U.S. PATENT DOCUMENTS 2,763,214 A * 9/1956 White ..... F04D 13/0613 417/357
2,863,525 A 12/1958 Lucian
3,046,900 A 7/1962 Pollak
3,260,214 A * 7/1966 Goettl ..... F04D 13/08 415/203
3,400,732 A 9/1968 Larrabee
3,667,870 A 6/1972 Yuji
3,684,096 A 8/1972 Kretchman
3,822,967 A 7/1974 Cade
3,899,726 A 8/1975 Ellmore
D237,011 S 9/1975 Stroberg
3,936,240 A 2/1976 Dochterman
D243,281 S 2/1977 Pareja
D252,811 S 9/1979 Arakawa
4,275,995 A * 6/1981 Taylor ..... B63B 13/00 417/360
4,345,879 A * 8/1982 Steiner ..... F04D 15/0218 417/40
4,435,879 A * 3/1984 van't Slot ..... B65B 25/064 452/174
4,482,300 A 11/1984 Brown
4,645,426 A * 2/1987 Hartley ..... F04B 49/025 417/38
4,820,131 A 4/1989 Johnson
4,856,971 A 8/1989 Koble, Jr.
4,961,018 A 10/1990 Akhter
5,055,000 A 10/1991 Akhter
D328,304 S 7/1992 Frohn
5,131,821 A 7/1992 Marioni
D329,651 S 9/1992 Kuwada
5,145,322 A 9/1992 Senior, Jr.
5,145,337 A 9/1992 Kirkland
5,181,841 A 1/1993 Kirkland
5,205,725 A 4/1993 Pattison
D335,292 S 5/1993 Schnell
5,494,414 A 2/1996 Steinhart
5,525,039 A 6/1996 Sieghartner
D372,034 S 7/1996 Handzel
5,599,164 A 2/1997 Murray
D394,067 S 5/1998 Kon
5,819,848 A 10/1998 Rasmuson
5,833,437 A * 11/1998 Kurth ..... F04D 13/086 417/372
5,997,261 A 12/1999 Kershaw
6,049,666 A 4/2000 Bennett
6,059,542 A 5/2000 Chou
6,149,390 A 11/2000 Fisher
6,375,430 B1 4/2002 Eckert
6,390,780 B1 * 5/2002 Batchelder ..... F04D 15/0236 417/18
6,423,218 B1 7/2002 Lindermeir
6,443,715 B1 9/2002 Mayleben
6,464,531 B2 10/2002 Eckert
D466,527 S 12/2002 Graber
6,530,758 B1 3/2003 Ritter
6,575,714 B2 6/2003 Pace
6,676,382 B2 1/2004 Leighton
D492,324 S 6/2004 Stevens
D501,486 S 2/2005 Leone
6,954,948 B1 10/2005 Asack
D517,570 S 3/2006 Stiles, Jr.
7,153,418 B2 12/2006 Mauro, Sr.
7,220,355 B2 5/2007 Palmer
7,264,449 B1 9/2007 Harned
D555,089 S 11/2007 Lutz
D589,060 S 3/2009 Metcalfe
7,544,041 B2 6/2009 Mayleben
D602,501 S 10/2009 Ton
7,597,732 B2 10/2009 Yokota
D603,870 S 11/2009 Mehnert
D611,504 S 3/2010 Ton
D649,164 S 11/2011 Cook
D667,466 S 9/2012 Barmore
8,297,952 B2 10/2012 Wu
8,380,355 B2 2/2013 Mayleben
8,529,228 B1 9/2013 Thompson
D691,638 S 10/2013 Alexander
D698,368 S 1/2014 Le
8,633,623 B2 1/2014 Bingler
8,636,898 B2 1/2014 Perez
D706,834 S 6/2014 Nowicki
D707,718 S 6/2014 Gomez
8,794,936 B2 8/2014 Tokuo
D738,402 S 9/2015 Nelson
D739,919 S 9/2015 Alexander
D744,003 S 11/2015 Ton
9,399,976 B2 7/2016 Ramamurthy
D769,332 S 10/2016 Varini
9,605,688 B2 3/2017 Perez
D788,932 S 6/2017 Ton
9,714,665 B2 7/2017 Saccoccio
9,768,662 B2 9/2017 Urata
9,810,241 B2 11/2017 Gell, III
D817,363 S 5/2018 Alexander
9,964,111 B2 5/2018 Yano
D823,345 S 7/2018 Wilds
D823,898 S 7/2018 Alexander
D836,677 S 12/2018 Alexander
D848,487 S 5/2019 van Opdorp
D868,117 S 11/2019 Mayleben
D875,142 S 2/2020 Wilds
D890,211 S 7/2020 Cooper
10,711,788 B2 7/2020 Mayleben
D893,552 S 8/2020 Mayleben
10,760,586 B2 9/2020 Saccoccio
D910,719 S 2/2021 Cooper
10,907,638 B2 2/2021 Wilds
D914,060 S 3/2021 Cooper
10,969,149 B2 4/2021 Schulaks
D918,268 S 5/2021 Cooper
11,162,496 B2 11/2021 Mayleben
2003/0002996 A1 1/2003 Pace
2003/0091440 A1 5/2003 Patel
2003/0161732 A1 8/2003 Kimberlin
2004/0040707 A1 3/2004 Dusterhoft
2005/0201858 A1 9/2005 Wang
2005/0231899 A1 10/2005 Barnes
2006/0043015 A1 3/2006 Palmer
2006/0064954 A1 3/2006 Yokota
2006/0081520 A1 4/2006 Lord
2006/0083630 A1 4/2006 Chen
2006/0275162 A1 12/2006 Mayleben
2007/0175225 A1 8/2007 Bahat
2008/0199326 A1 8/2008 Masoudipour
2011/0123357 A1 5/2011 Leone
2013/0214895 A1 8/2013 Ullermann
2014/0166109 A1 6/2014 Takai
2014/0286747 A1 9/2014 Fang
2014/0341752 A1 11/2014 Gell, III

(56) References Cited

U.S. PATENT DOCUMENTS

| | | | |
|---|---|---|---|
| 2015/0167673 | A1 | 6/2015 | Saccoccio |
| 2015/0308425 | A1 | 10/2015 | Skotty |
| 2016/0037987 | A1 | 2/2016 | Caro |
| 2017/0030371 | A1 | 2/2017 | Wilds |
| 2019/0048875 | A1 | 2/2019 | Mayleben |
| 2019/0154061 | A1 | 5/2019 | Gilliland |
| 2019/0309757 | A1 | 10/2019 | Rejniak |

FOREIGN PATENT DOCUMENTS

| | | | |
|---|---|---|---|
| EM | 000673363 | | 2/2007 |
| EM | 000777123 | | 8/2007 |
| EM | 001379309 | | 7/2013 |
| EM | 001388441 | | 10/2013 |
| EM | 0027086770002 | | 5/2015 |
| EM | 0027086770004 | | 5/2015 |
| EP | 1178212 | | 2/2002 |
| EP | 1241357 | | 9/2002 |
| EP | 3058800 | A1 | 8/2016 |
| GB | 1320841 | A | 6/1973 |
| RU | 2489784 | | 7/2013 |
| RU | 166537 | | 11/2016 |
| WO | 0017521 | | 3/2000 |
| WO | 2006137777 | | 12/2006 |
| WO | 2011137425 | | 11/2011 |
| WO | 2012037991 | | 3/2012 |

OTHER PUBLICATIONS

Wayne Water Systems, Wayne TSC Submersible Utility Pump Operating Instructions and Parts Manual, Jan. 2000, pp. 1-4, 2 pp.

Wayne Water Systems, Wayne TSC130/250 Submersible Utility Pump Operating Instructions and Parts Manual, Nov. 1999, pp. 1-4, 2 pp.

Wayne/Scott Fetzer Company, Wayne TSC130 Dewatering Pump Operating Instructions and Parts Manual, May 20, 2016, pp. 1-8, 8 pp.

Wayne/Scott Fetzer Company, Wayne TSC160 Dewatering Pump Warranty & System Installation Guide, May 20, 2016, pp. 1-11, 11 pp.

Amazon.com, Apple MFi Certified Lightning to USB Cable, Built-in LED in Lightning Connector, Heavy Duty Charge & Sync Cable, showing a product that was on sale or publicly disclosed more than a year before the filing date of the instant application, 13 pp.

Blue Angel Pump Company, Blue Angel Catalog, 2018, 34 pp.

Blue Angel Pump Company, Blue Angel Catalog, Oct. 2015, 39 pp.

Patent Cooperation Treaty, International Searching Authority, Notification of Transmittal of the International Search Report and the Written Opinion of the International Searching Authority, or the Declaration issued in International Application No. PCT/US2018/046604, dated Nov. 29, 2018, 11 pp.

Wayne Water Systems, Wayne Catalog, Oct. 2014, 52 pp.

Wayne/Scott Fetzer Company, Operating Instructions and Replacement Parts List, Submersible Utility Pumps VIP Series, that discloses a pump that was on sale or publicly disclosed more than 1 year before the filing date of the instant application, 2011, 12 pp.

Wayne/Scott Fetzer Company, Watering & System Installation Guide, Dewatering Pump TSC, that discloses a pump that was on sale or publicly disclosed more than 1 year before the filing date of the instant application, 2016, 11 pp.

* cited by examiner

PUMP ASSEMBLY AND RELATED METHODS

CROSS-REFERENCE TO RELATED APPLICATIONS

This application claims the benefit of U.S. Provisional Application No. 62/908,458, filed Sep. 30, 2019, and U.S. Provisional Application No. 63/085,031, filed Sep. 29, 2020, which are incorporated by reference herein in their entirety.

FIELD

This invention relates generally to pumps and, more particularly, to pumps with integral float switches and/or venting to prevent airlocks, and methods related to the same.

BACKGROUND

Pumps are commonly made having a volute, an impeller within the volute, a motor connected to the impeller, and a discharge in the volute for discharging water drawn into the volute by the impeller.

There are multiple types of pumps including top suction and bottom suction pumps. These pumps include fluid chambers such as volutes with inlets on the top (e.g., top suction pumps) or the bottom (e.g., bottom suction pumps) and an outlet to expel fluid from. Rotation of the impeller draws water through the inlet and also creates air flow and air bubbles within the volute. As a result, if not properly vented, a bottom suction pump may suffer from air lock.

Accordingly, a need exists for a pump assembly that prevents the pump from being air locked.

BRIEF DESCRIPTION OF THE FIGURES

Embodiments of the invention are illustrated in the figures of the accompanying drawings in which.

Figure 1A:
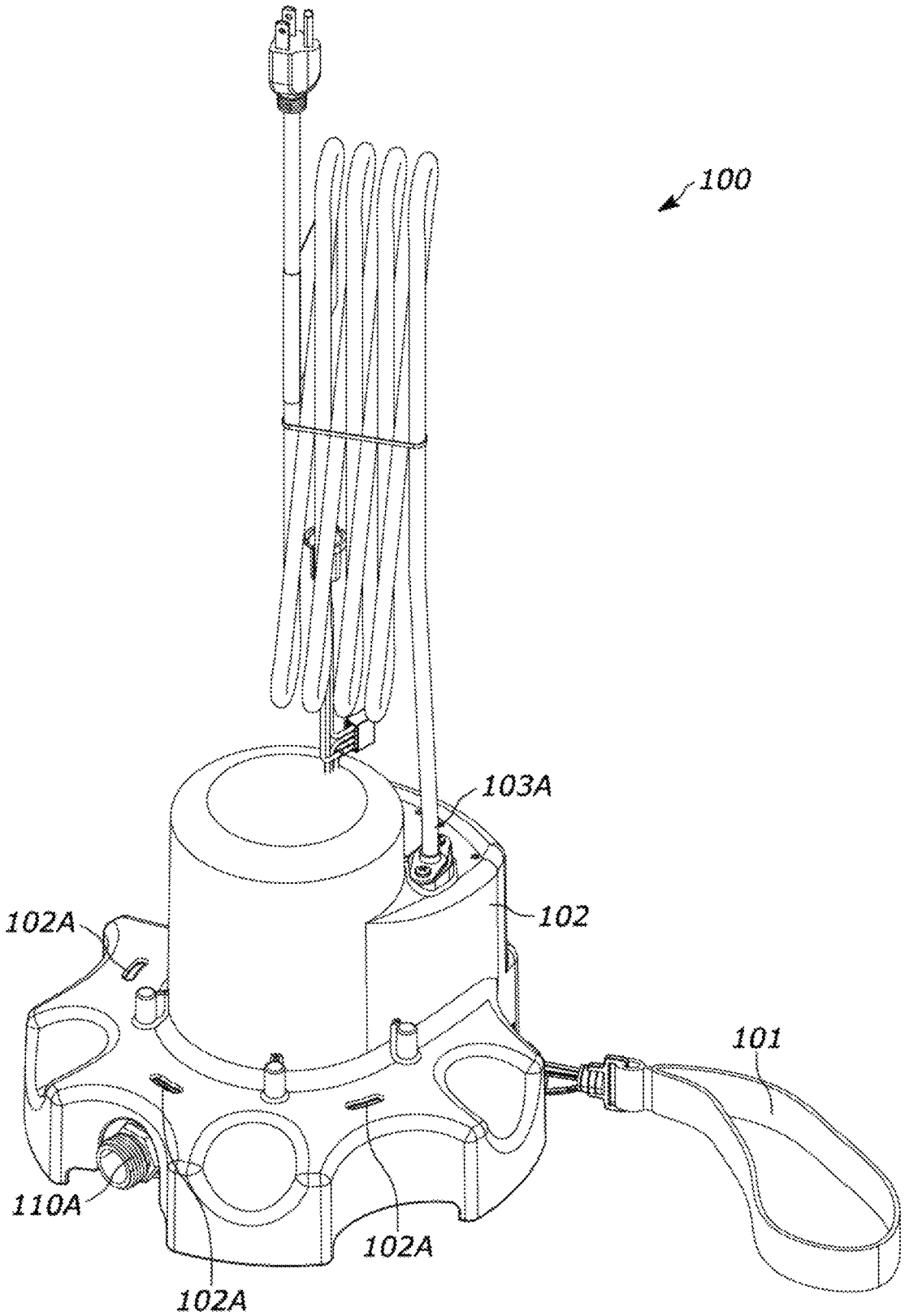
FIG. 1A is a top perspective view of a pump having a housing.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DESCRIPTION OF THE PREFERRED EMBODIMENTS

Many variations of pumps are discussed herein and even further are contemplated in view of this disclosure. The pumps discussed herein are configured, and designed, to be submerged in a liquid to pump the liquid in which it is submerged through an attached discharge hose or discharge pipe. The pumps herein can be utility pumps, sump pumps, well pumps, sewage/effluent pumps, aquarium pumps, pool pumps, lawn pumps, or any other type of pump. The pumps herein can be vertically configured pumps or horizontally configured pumps. They may be top suction pumps, bottom suction pumps, or a combination of both (e.g., top and bottom suction), and as will be read herein, these may include an integral float switch integrated into the pump housing and/or include venting for preventing airlocks or vapor locks from occurring with respect to the pump.

The pump 100 comprises a pump housing 102 having a channel 104A. The channel 104A receives a float switch 111 that is contained within a protrusion 106 of the pump housing 102.

The pump 100 further comprises a fluid chamber 110 that is generally cylindrical in shape, and has a top portion 122 having a top surface 122A and a sidewall 122B, the top surface 122A extending inward and upward from the sidewall 122B to an outlet 114. The top portion 122 of the fluid chamber 110 is generally conical in shape.

FIGS. 1A-6B illustrate a pump 100 having a lanyard 101, the housing 102 having the protrusion 106, fastener receivers 108, the first channel 104A, a second channel 104B, a cavity 105, inlet gaps 107B, filter teeth 107A, a power supply 103A, a control circuit 103B, the fluid chamber 110, a discharge outlet 110A, and a motor housing 112 housing a motor 115A. The motor 115A is coupled to a shaft 115B that the motor 115A turns when operating.

Figure 1B:
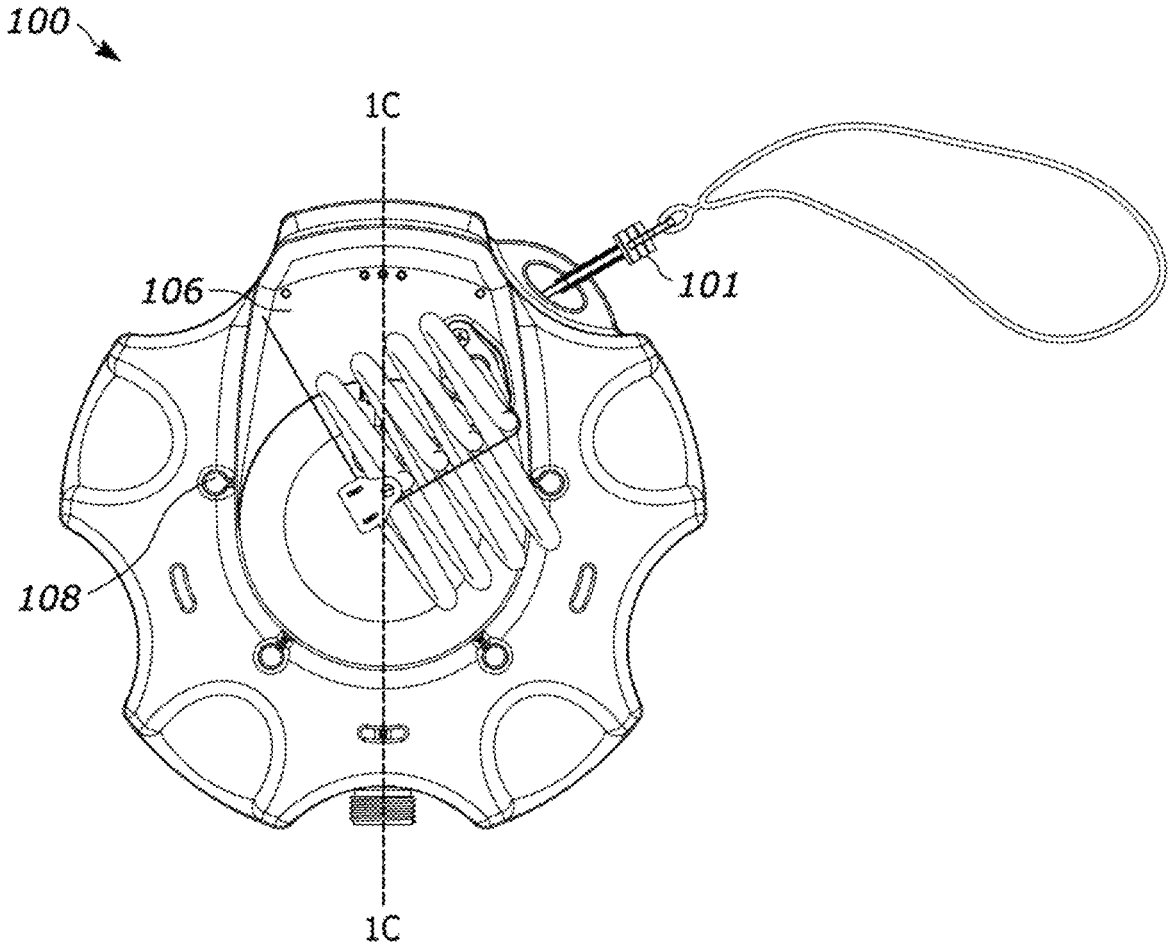
FIG. 1B is a top plan view of the pump of FIG. 1A.
Figure 1C:
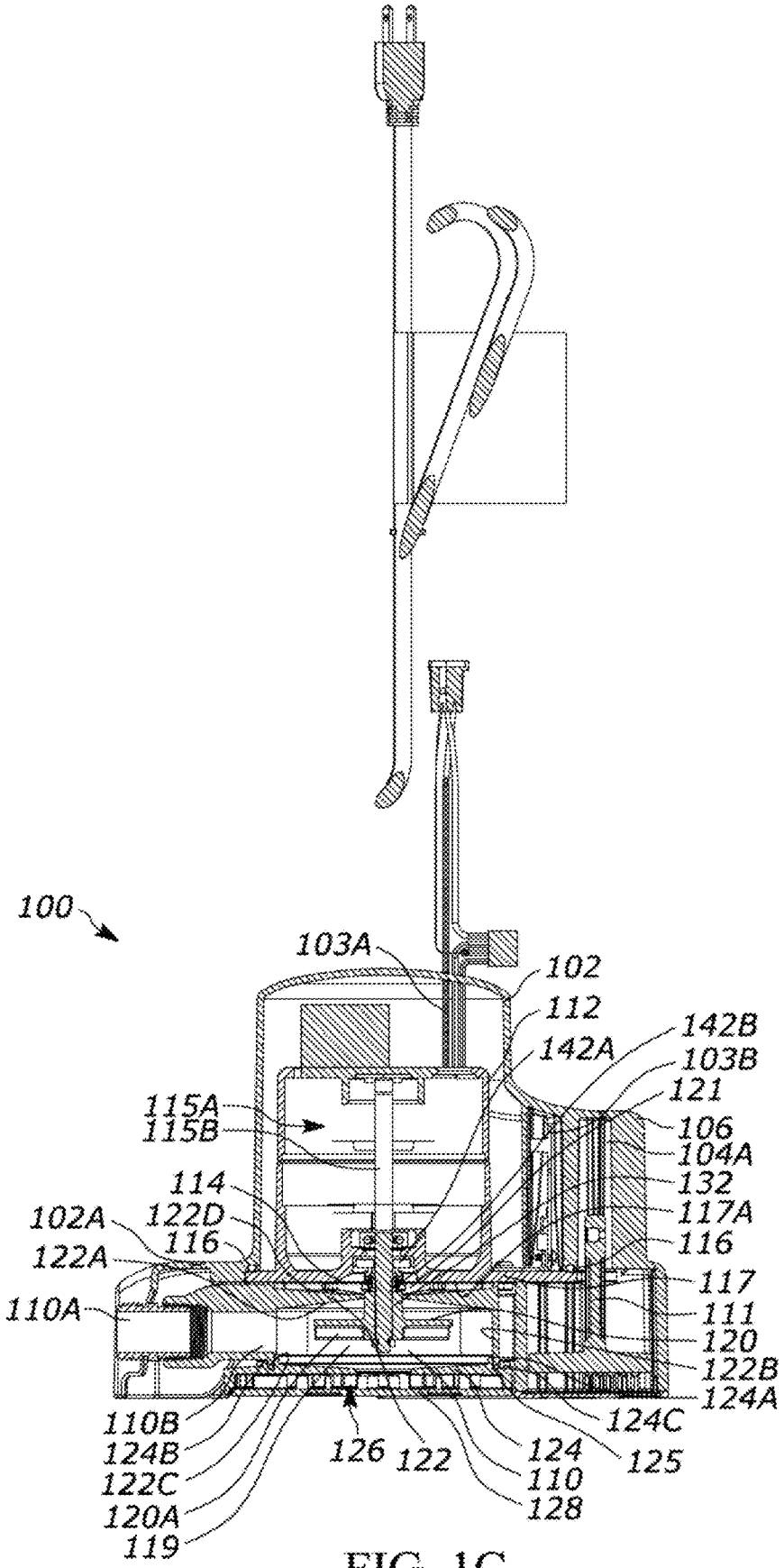
FIG. 1C is a cross-section view of the pump of FIG. 1A taken along lines 1C-1C of FIG. 1A.

The discharge outlet 110A extends through a sidewall of the fluid chamber 110. In a preferred embodiment, the discharge outlet 110A is a fitting, such as an NTP fitting. As shown in FIGS. 1A-1C, the discharge outlet 110A may include threads disposed on an end thereof for coupling to a discharge hose, for example the fitting of a garden hose.

The pump 100 further comprises a seal 116 and a sealing plate 117. The sealing plate 117 and seal 116 separate and fluidically isolate the water intake portion of the pump 100 from cavity of the pump housing 102 that contains the motor 115A. In the form shown, the seal 116 is a static gasket, such as a square section gasket. The pump 100 further includes a mechanical seal 142 comprised of a first seal 142A and a second seal 142B. The first seal 142A includes a sliding ring that encircles the shaft 115B of the motor 115A. The first seal 142A includes a rubber sealing member that abuts against the sealing plate 117 to inhibit fluid from passing into the motor housing 112. The second seal 142B encircles the shaft 115B of the motor 115A and extends from the first seal 142A to the hub 132 of the impeller 120. The second seal 142B may include a spring that forces the second seal 142B into engagement with the first seal 142A and the hub 132 of the impeller 120 to aid in preventing fluid from entering the motor housing 112 along the shaft 115B of the motor 115A. The second seal 142B may force and/or bias the first seal 142A against the sealing plate 117. The second seal 142B further includes a rubber sealing member that engages the hub 132 of the impeller 120 to fluidically isolate the motor shaft 115B from the air cavity 121

Additionally, the sealing plate 117 serves as a heat sink. Heat generated during operation of the motor is conducted to the sealing plate 117. Heat is dissipated as fluid flows through the pump 100 because it flows through and comes in contact with a bottom surface 117A of the sealing plate 117.

Figure 10:
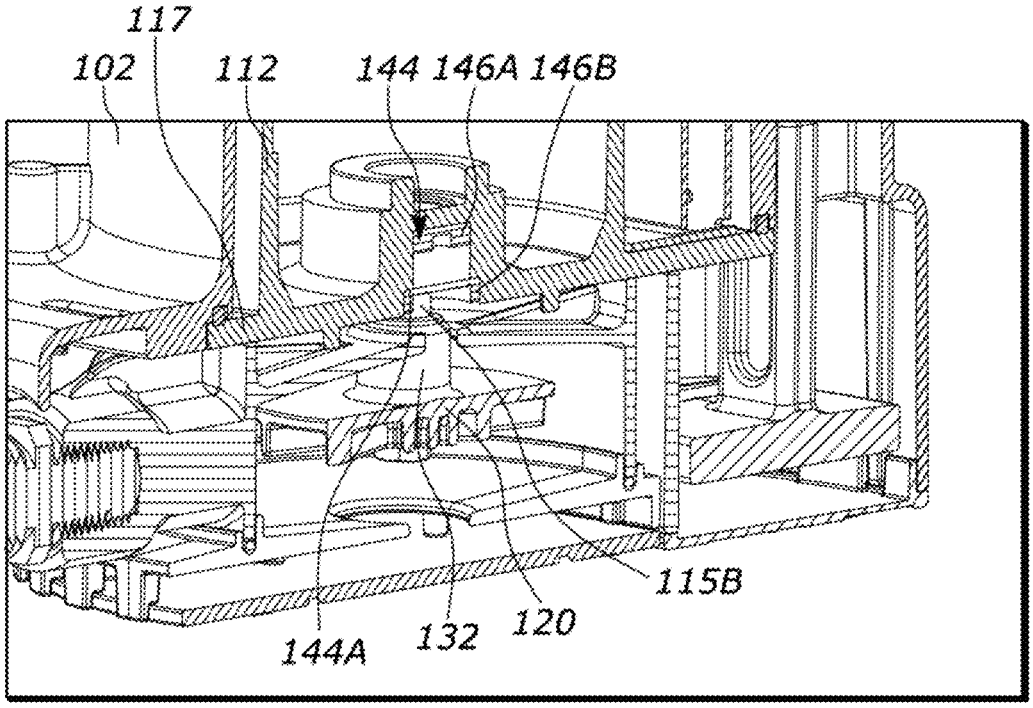
FIG. 10 is a perspective view of a cross-section of the pump of FIG. 1A having an alternative motor housing seal.

In an alternative embodiment shown in FIG. 10, the pump 100 includes a motor housing 112 having a stepped recess 144 formed within the sealing plate 117. The stepped recess 144 of the motor housing 112 includes two seals 146A and 146B disposed therein to prevent fluid from entering the motor housing 112 along the shaft 115B of the motor 115A. Including two seals 146A and 146B provides redundancy to further ensure that fluid does not enter the motor housing 112, which may result in damage to the motor 115A. The seals 146A and 146B may be lip seals that include a central opening that receive the shaft 115B of the motor 115A therethrough. The shaft 115B of the motor 115A rotates within the seals 146A and 146B with the seals 146A,B remaining engaged with the shaft 115A to inhibit fluid from traveling along the motor shaft 115B and into the motor housing 112. The first seal 146A has a larger diameter than the second seal 146B. The first seal 146A is disposed within a larger diameter portion of the stepped recess 144 and extends from the shaft 115B to the walls of the larger diameter portion of the stepped recess 144. The first seal 146A engages a shoulder 144A of the stepped recess 144 that prohibits the first seal 146A from entering further into the stepped recess 144. The second seal 146B is disposed within the smaller diameter region of the stepped recess 144 and extends from the shaft 115B to the walls of the stepped recess 144. In a preferred form, the lip seals each face the same direction with the second seal serving as a redundant or back-up seal for the first. The seals are friction fit within their recesses and do not rotate, but may be coated with a lubricant, such as an oil, to allow the motor shaft to rotate within the central opening of the lip seals without allowing the seals to leak fluid.

The pump 100 further includes an impeller 120 operably connected to the shaft 115B of the motor 115A. The impeller 120 has a plurality of vortex vanes 120A disposed on the bottom surface thereof and is housed in a fluid chamber 110. In other embodiments, the impeller includes radial vanes dispensed on the bottom surface of the impeller 120. Referring to FIG. 1B, rearward of the fluid chamber 110 is a float switch 111. The float switch 111 is used to control operation of the motor 115A by detecting the presence of fluid, such as water.

In some embodiments, the pump 100 does not have a motor housing 112, and, instead, the motor 115A is contained within the pump housing 102.

Figure 4A:
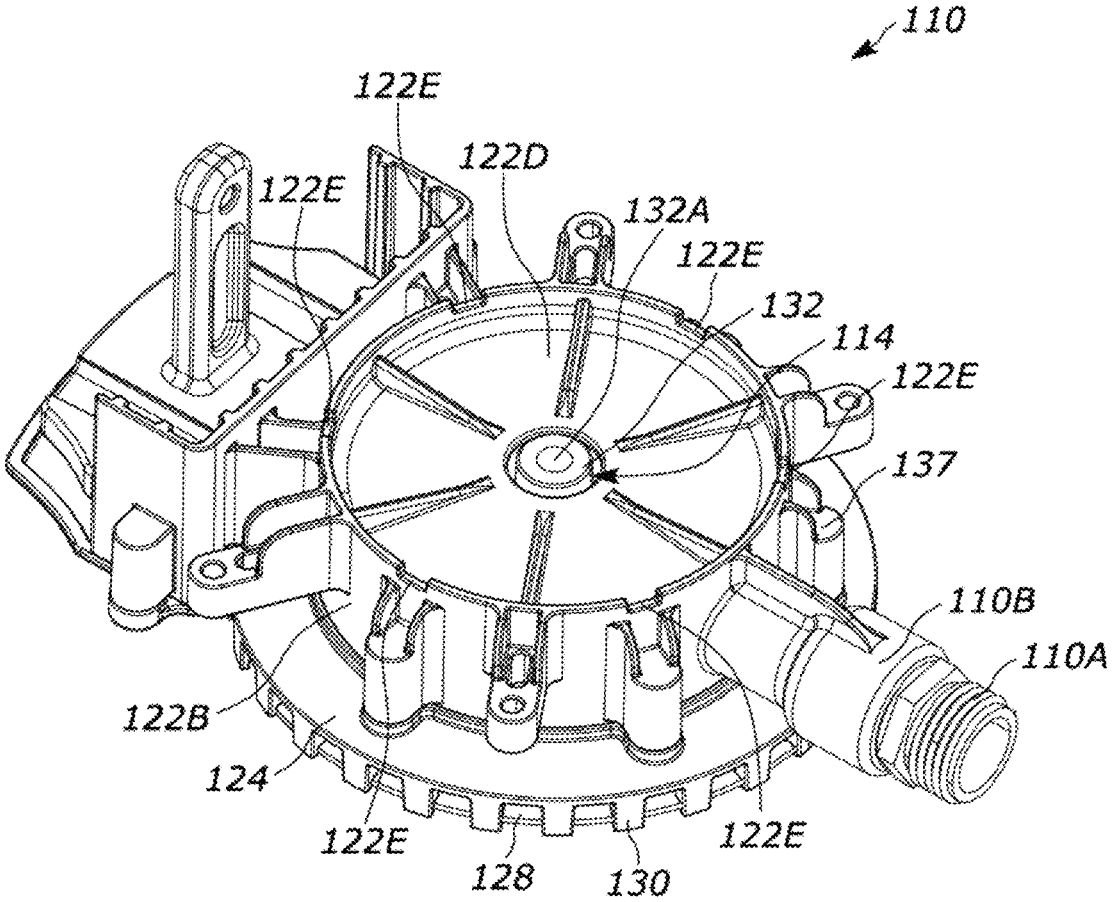
FIG. 4A is a top perspective view of the fluid chamber and float switch of the pump of FIG. 1A.
Figure 4B:
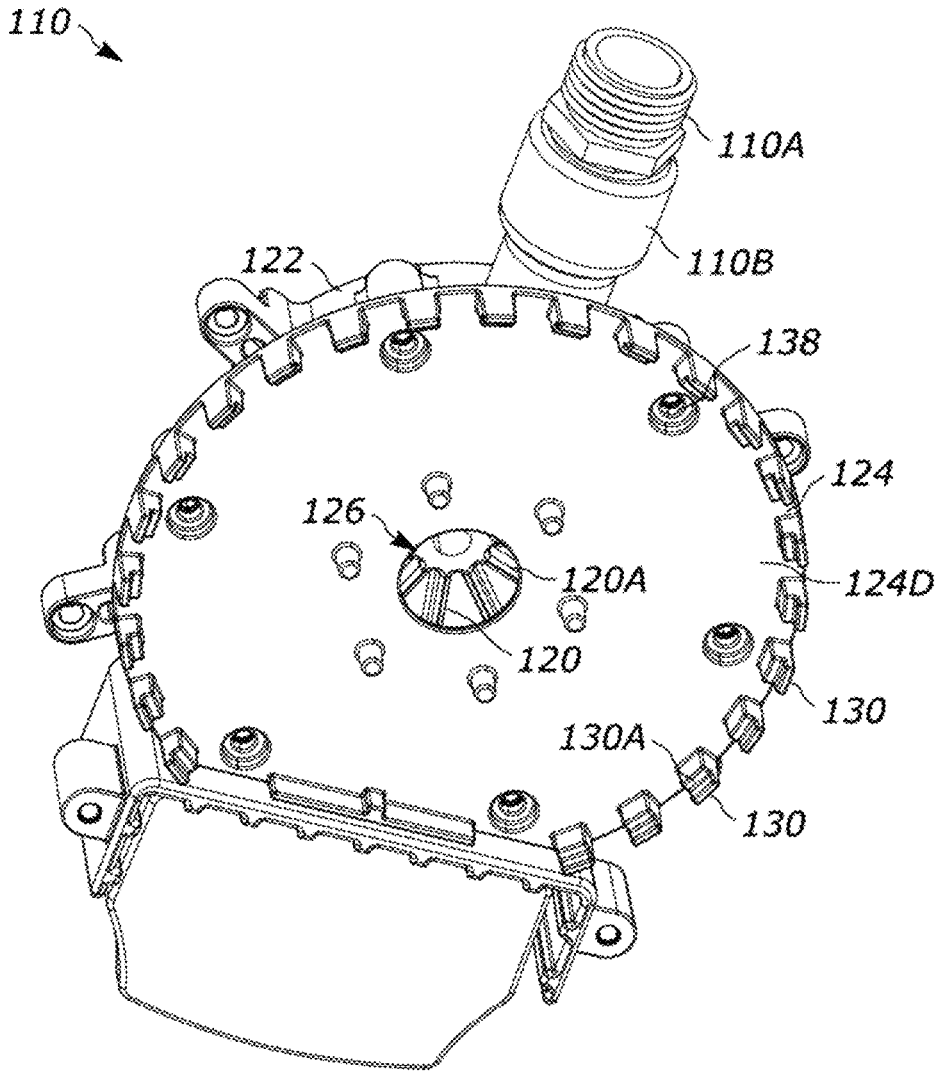
FIG. 4B is a bottom perspective view of the fluid chamber and float switch shown in FIG. 4A.
Figure 5:
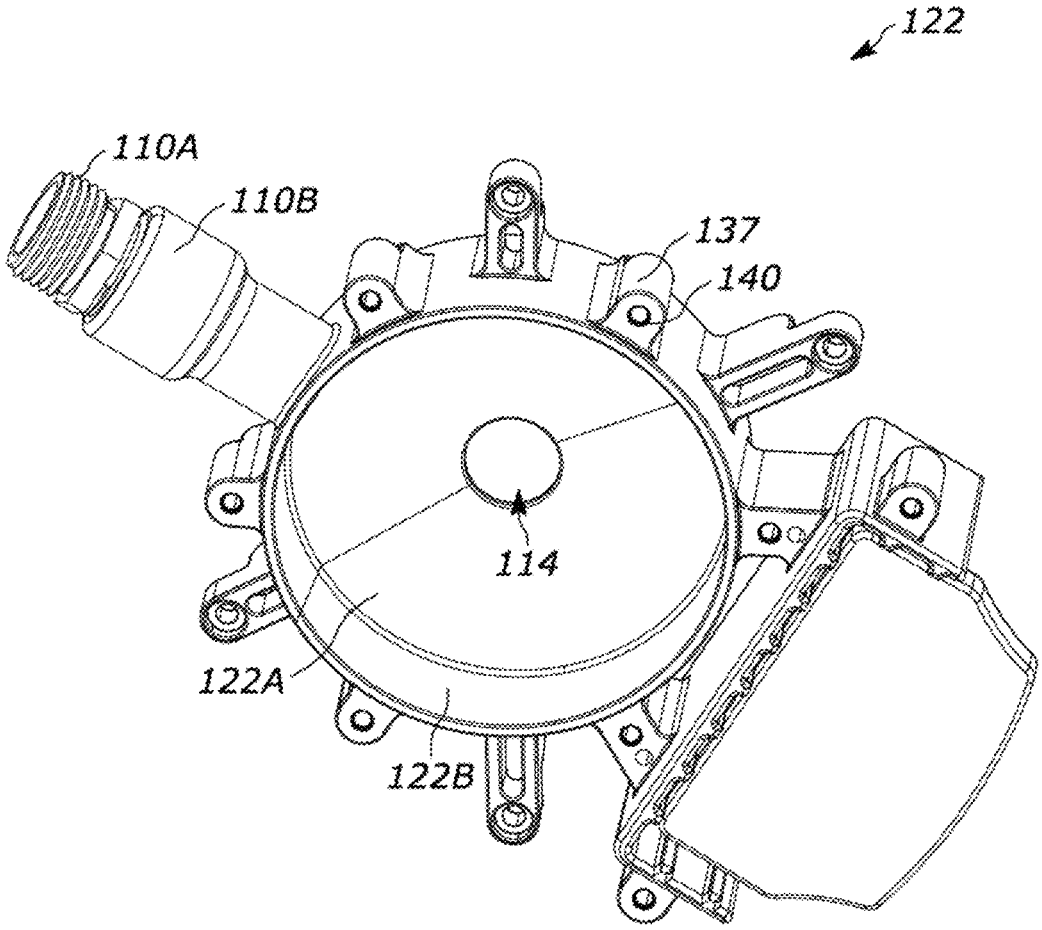
FIG. 5 is a bottom perspective view of a top portion of the fluid chamber of the pump of FIG. 1A.
Figure 6A:
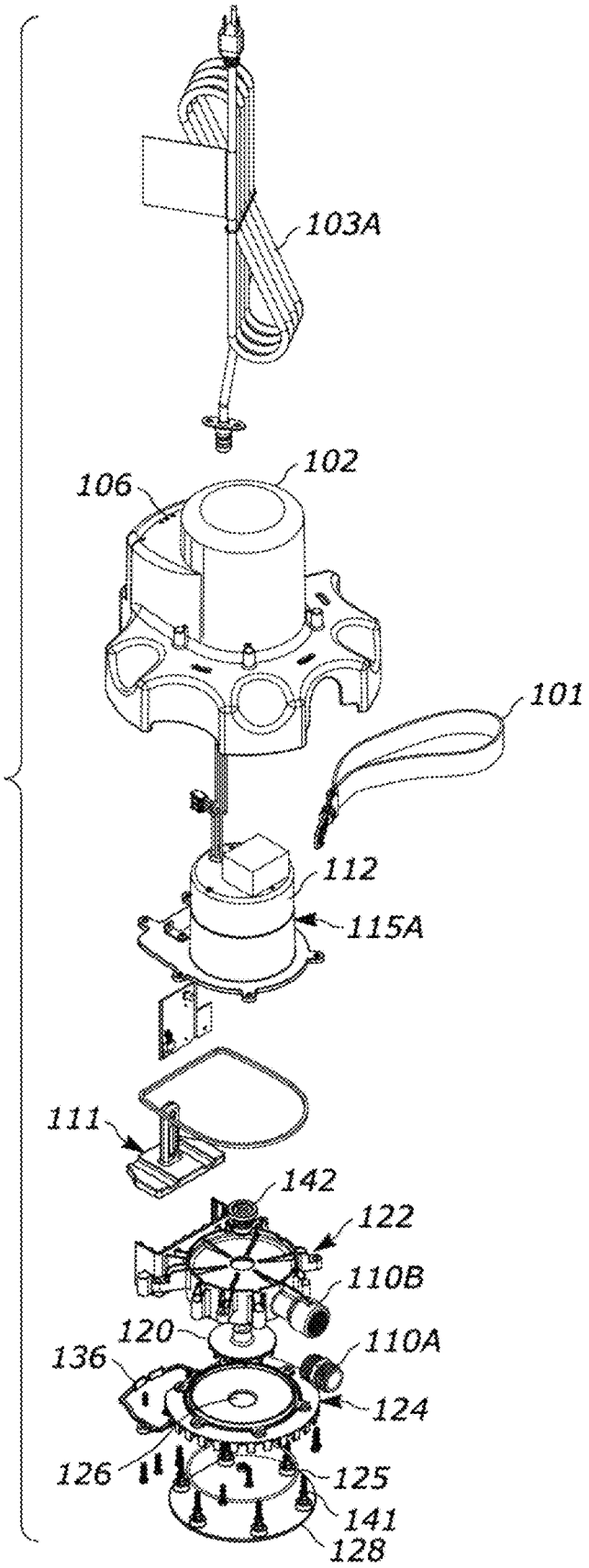
FIG. 6A is a top perspective exploded view of the pump of FIG. 1A.
Figure 6B:
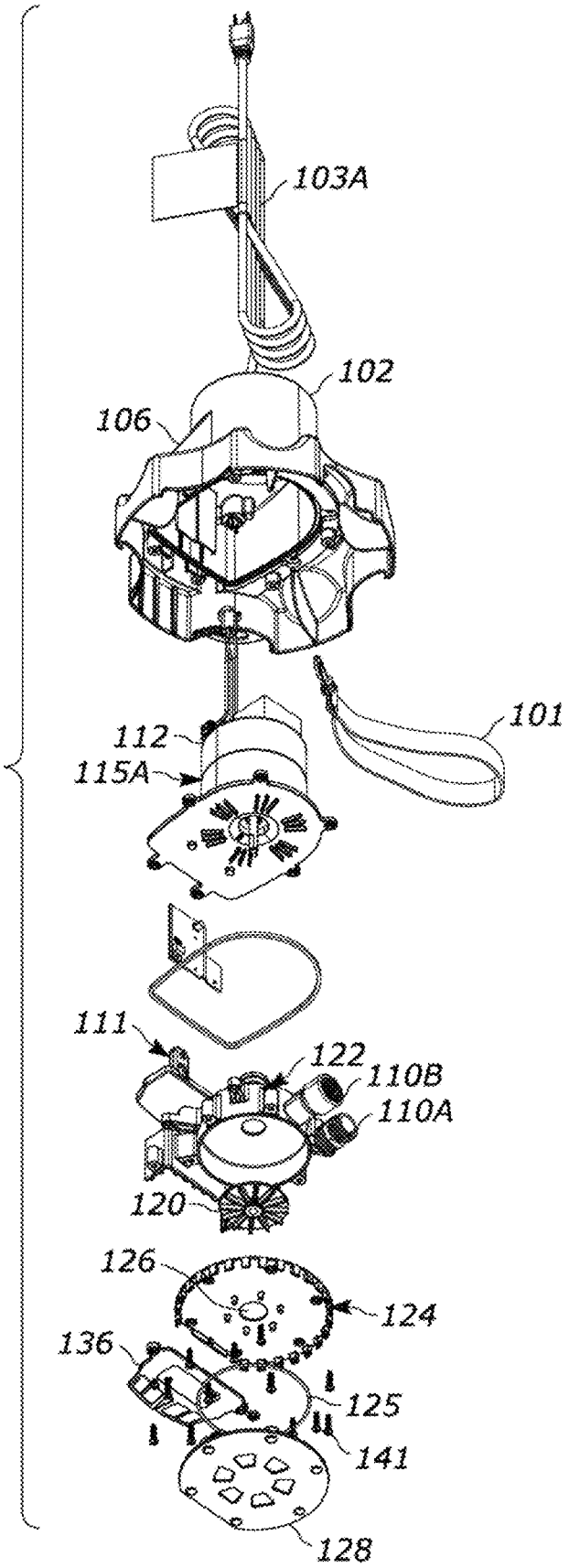
FIG. 6B is a bottom perspective exploded view of the pump of FIG. 1A.

FIG. 1C shows a cross-sectional view of the pump 100 and the fluid chamber 110 taken along the line 1C-1C of FIG. 1B. The fluid chamber 110 has an inlet 126 and an outlet 114, as well as a discharge 110B, which is directly connected to a hydraulic cavity 119 defined by the fluid chamber 110. The outlet 114 is an opening through which air may be vented from the cavity 119 of the fluid chamber 110 during operation of the pump 100. The outlet 114 extends from the hydraulic cavity 119 to an air cavity 121 in between the motor housing 112 and the fluid chamber 110. As shown in FIG. 4A, the sidewall 122B of the fluid chamber 110 protrudes above the exterior top surface of the top portion 122 of the fluid chamber 110. The top edge of the side wall 122B that abuts the motor housing 112 includes notches 122E through which air within the air cavity 121 is able to exit the air cavity 121. As shown in FIG. 1A, the pump housing includes holes or vents 102A that extend through a surface of the pump 100. Thus, air within the hydraulic cavity 119 may flow into the air cavity 121 through the outlet 114. As shown in FIG. 1E, the air then flows along path 123 through the notches 122E in the sidewall 122B of the fluid chamber 110, and out of the pump 100 via the vents 102A in the pump housing 102. Thus, the outlet 114 in the interior top surface 122A of the top portion 122 allows air to be vented from the fluid chamber 110.

In a preferred embodiment, the pump 100 is a circular pump with the discharge 110A extending radially from the cylindrical sidewall of the fluid chamber 110. In this embodiment, the impeller 120 may be rotated in both clockwise and counterclockwise directions to pump fluid through the discharge 110A. In alternate embodiments, other pump configurations may be used. As one example, the pump 100 may be a circular pump with a discharge 110A extending tangentially from the fluid chamber 110. As another example, the fluid chamber 110 of the pump 100 may be a volute that has a sidewall that increases in radius from a central point of the fluid chamber 110 and has a tangential discharge.

The power supply 103A is operably connected to the control circuitry 103B. While it is referred to as a power supply, it should be understood that power supply refers to a power cord connected to a power supply, such as mains power. The control circuitry 103B controls the power supply 103A to selectively provide power to the motor 115A. The control circuitry 103B may include or be in communication with a sensor that detects the fluid level in which the pump 100 is submerged such as the float switch 111 or a capacitive water sensor. Alternatively, the control circuitry 103B may include a switch operable by a user. For example, the switch may be movable between "On" and "Off" positions such that when the switch is moved to the "On" position, the control circuitry 103B causes the pump 100 to operate.

In some embodiments, the fluid chamber 110 may include a top portion 122 and a bottom portion 124. The top portion 122 and the bottom portion 124 are fastened together using fasteners which extend through holes 138 of the of the cover plate 128 and bottom portion 124 and into holes 140 of fastener receivers 137 of the top portion 122. The bottom portion 124 further includes an annular inner wall 124A and an annular outer wall 124B. The top portion 122 includes a sidewall 122B having a bottom ridge 122C, which is received in an annular groove 124C defined by the annular inner and outer walls 124A, 124B of the bottom portion 124. A seal 124A, such as an O-ring, is positioned within the annular groove 124C to inhibit fluid from exiting the fluid chamber 110 via the interface between the top portion 122 and the bottom portion 124. In other embodiments, the volute 110 may be a unitary or one-piece configuration.

In some embodiments, the bottom portion 124 of the fluid chamber 110 has a ring of filter teeth 130 extending downward from a bottom surface 124D of the bottom portion 124. The filter teeth 130 include stepped shoulders 130A on the inner side thereof for receiving a cover plate 128. The cover plate 128 is positioned within the ring of filter teeth 130 and engages the stepped shoulder 130A of each of the teeth 130. The fluid chamber 110 further includes spacers 131 protruding from the bottom surface 124D of the bottom portion 124. These spacers 131 ensure that cover plate 128 remains spaced a sufficient distance from the bottom surface 124D to allow a sufficient amount of water to be drawn into the fluid chamber 110 via the inlet 126. The cover plate 128 may be fastened to the fluid chamber 110 by fasteners 141 that extend through the cover plate 128 and the bottom portion 124 and top portion 122 of the fluid chamber 110, as both the top portion 122 and bottom portion 124 of the fluid chamber 110 each have fastener receivers 140. The cover plate 128 and bottom portion 124 of the fluid chamber 110, when fastened together, thus form a filter. Fluid flows through the gaps between the teeth 130 of the ring of teeth 130 and then flows into the inlet 126 of the fluid chamber 110. The ring of teeth 130 inhibit other objects, such as a pool cover or debris, from entering the fluid chamber 110 of the pump 100.

Figure 3A:
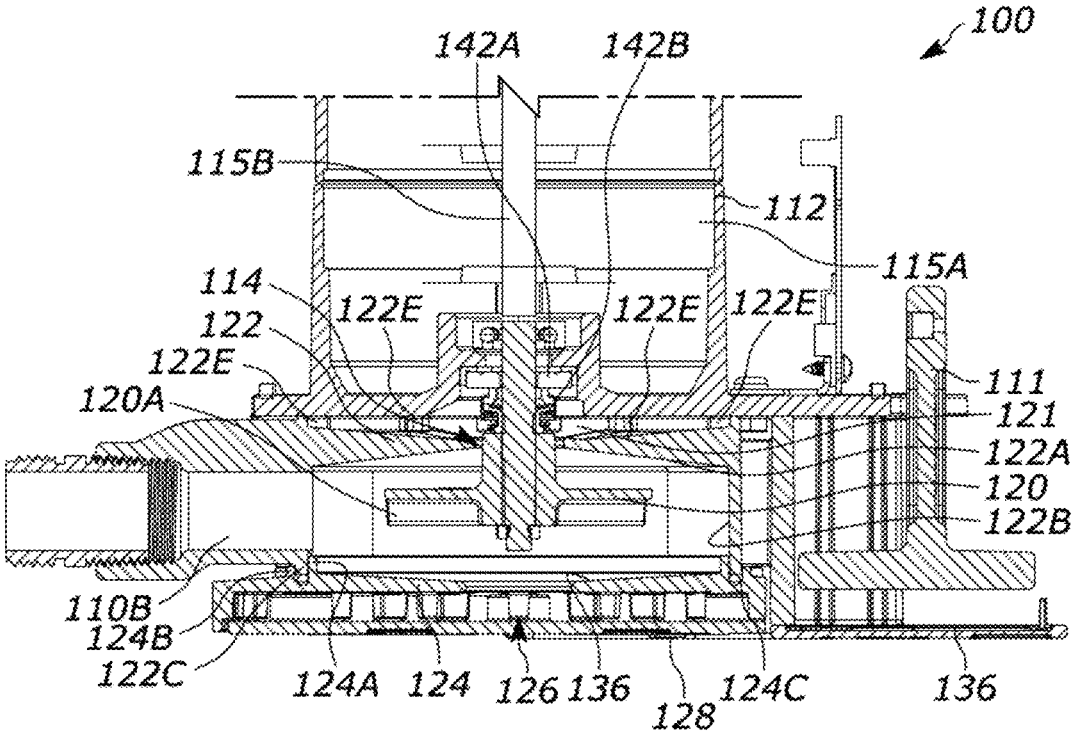
FIG. 3A is a portion of the cross-section view of FIG. 1C showing a fluid chamber, the impeller, a motor, a motor housing, and the float switch of the pump of FIG. 1A.
Figure 3B:
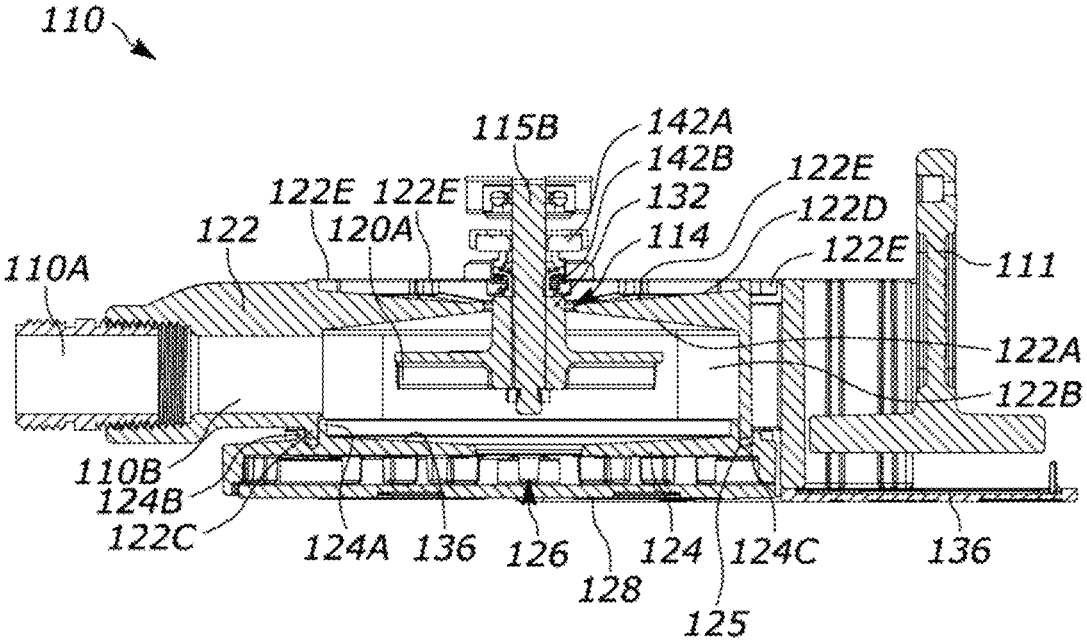
FIG. 3B is a portion of the cross-section view of FIG. 1C showing the fluid chamber, impeller, and float switch of the pump of FIG. 1A.

For clarity, some parts have been removed in certain drawings for better viewing of certain aspects of the volute 110 and other components of the pump 100. For example, the cover plate 128 is not shown in FIG. 4B, but it is shown in FIGS. 4A, 3A, and 3B.

The impeller 120 is positioned within the fluid chamber 110 which includes an outlet 114, an inlet 126, and a discharge 110B connected to a discharge outlet 110A. The inlet 126 is in fluid communication with the impeller 120, meaning fluid is drawn through the inlet 126 by the impeller 120 when the motor 115A rotates the impeller 120. The outlet 114 is in fluid communication with the inlet 126 such that fluid such as air may be drawn through the inlet 126 by the impeller 120 and travel out the outlet 114. The inlet 126 is also in fluid communication with the discharge outlet 110A such that fluid flows into the pump 100 through the inlet 126 and out the discharge outlet 110A. Rotation of the impeller 120 by the motor 115A thus causes a first fluid flow drawing fluid into the hydraulic cavity 119 of the fluid chamber 110 via the inlet 126. The vanes 120A on the bottom of the impeller 120 create a flow within the fluid chamber 110 that directs the fluid out the discharge 110A and draws fluid into the fluid chamber 110 via the inlet 126. The impeller 120 further creates a second flow causing air within the fluid drawn into the fluid chamber 110 to travel along the interior top surface 122A of the top portion 122 of the fluid chamber, through the outlet 114, and out the vents 102A in the pump housing 102.

The fluid chamber 110 is generally cylindrical in shape and has a top portion 122 having a top surface 122A and sidewall 122B, a bottom portion 124 having a bottom surface 124D and the annular inner and outer walls 124A, 124B, which define the annular groove 124C, and a cover plate 128. The top portion 122 of the fluid chamber 110 defines a hole therein through which the shaft 115B of the motor 115A and an annular neck portion 132A of the hub 132 of the impeller 120 extend. The outer diameter of the annular neck portion 132A of the hub 132 is less than the diameter of the hole in the top portion 122 of the fluid chamber 110. The space between the outer surface of the hub 132 and the portion of the top surface 122A of the fluid chamber 110 defines the outlet 114. As described above, the outlet 114 aids in venting the fluid chamber 110 to reduce the likelihood of the impeller 120 failing due to an air lock or, as it is otherwise known, a vapor lock. The top surface 122A of the volute 110 extends inward and upward toward the outlet 114 and at an angle or slope relative to the sidewall 122B, such that the top portion 122 of the volute 110 is generally conical in shape. The interior top surface 122A forms a frustoconical shape, however, in other embodiments, the interior top surface 122A may have any other shape that allows and directs air within the fluid chamber 110 toward the outlet 114. Other examples of shapes include an arcuate or parabolic cross-sectional shape.

When the impeller 120 rotates, drawing in fluid through the inlet 126, this creates a second flow, such as residual air flow, which creates air pockets. Since the interior top surface 122A has a slope or curvature toward the outlet 114, the air pockets within the fluid chamber 110 migrate along the inclined top surface 122A to the outlet 114. Drawing the air pockets to the outlet 114 reduces the risk of the pump 100 failing due to air lock as the air may be vented through the outlet 114 and into the air cavity 121 and out the vents 102A in the pump housing 102.

The exterior top surface 122D of the top portion 122 of the fluid chamber 110 may also be sloped toward the outlet 114. The exterior top surface 122D may have any shape or slope that guides any fluid that travels into the air cavity 121 and is on the exterior top surface 122D of the top portion 120 of the fluid chamber 110 back into hydraulic cavity 119 of the fluid chamber 110. In the embodiment shown, the exterior top surface 122D has an inverted frustoconical shape. In other embodiments the exterior top surface 122D may have an accurate or parabolic cross-section shape.

Referring to FIGS. 3A-3B, the fluid chamber 110 has an open top which forms the outlet 114 and a center aperture in the bottom to form inlet 126. The volute 110 defines an open cavity between the inlet 126, and outlet 114 in which the impeller 120 is positioned. The top surface 122A of the top portion 122 of the volute 110 extends upward and inward at an angle to the sidewall 122B such that the general shape of the fluid chamber 110 is conical until it terminates at point 114A, thus forming the outlet 114. Air bubbles travel along the top surface 122A of the top portion 122 of the volute 110 and out the outlet 114.

Figure 1D:
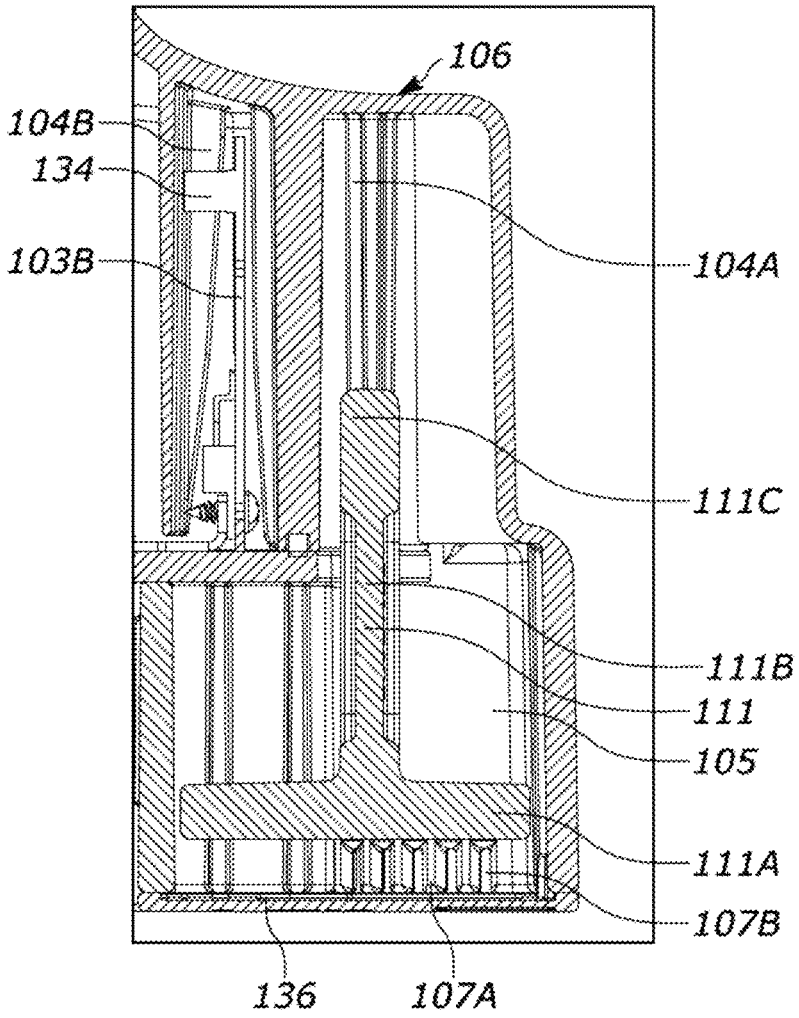
FIG. 1D is a portion of the cross-section view of FIG. 1C showing a float switch contained in the housing of the pump of FIG. 1A.
Figure 1E:
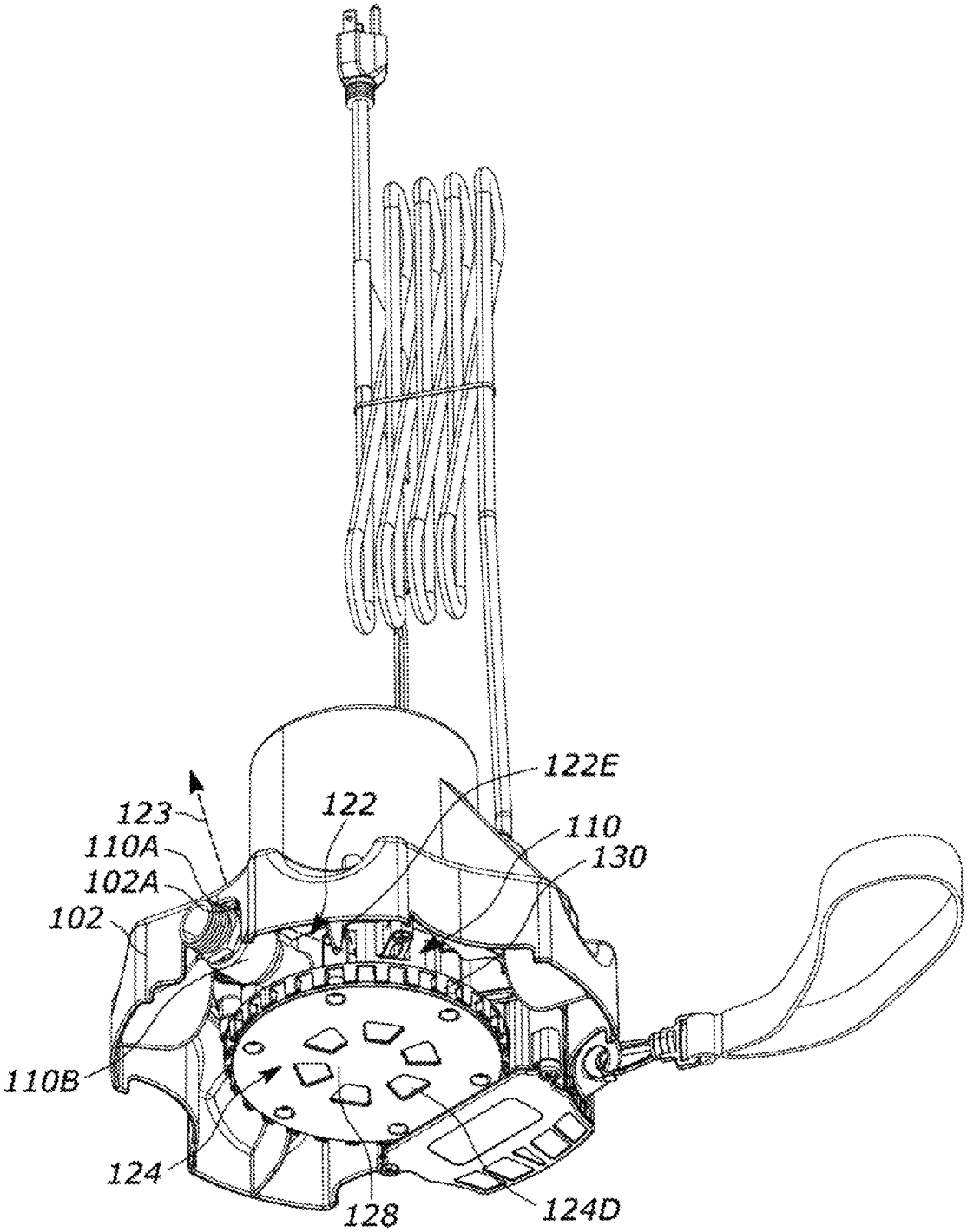
FIG. 1E is a bottom perspective view of the pump of FIG. 1A.
Figure 2A:
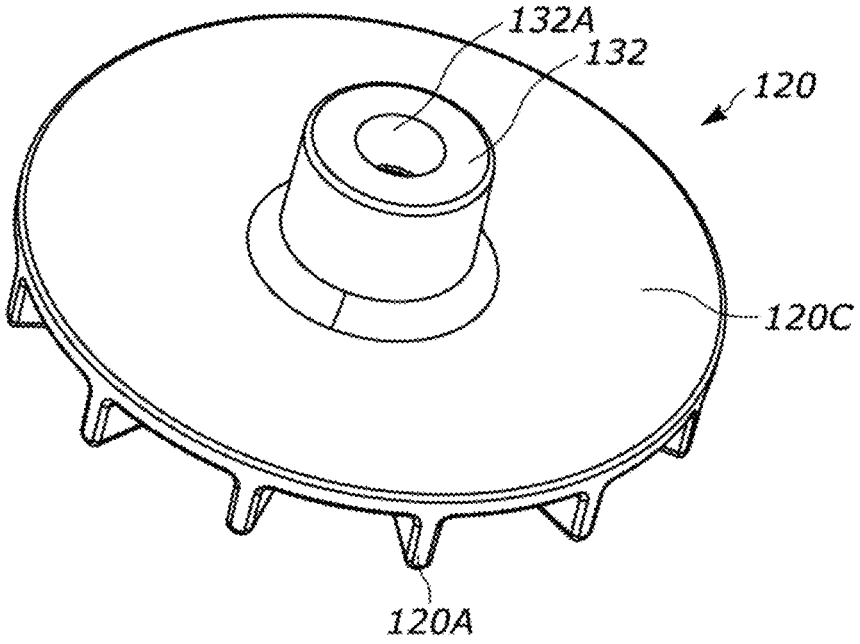
FIG. 2A is a top perspective view of an impeller of the pump of FIG. 1A.
Figure 2B:
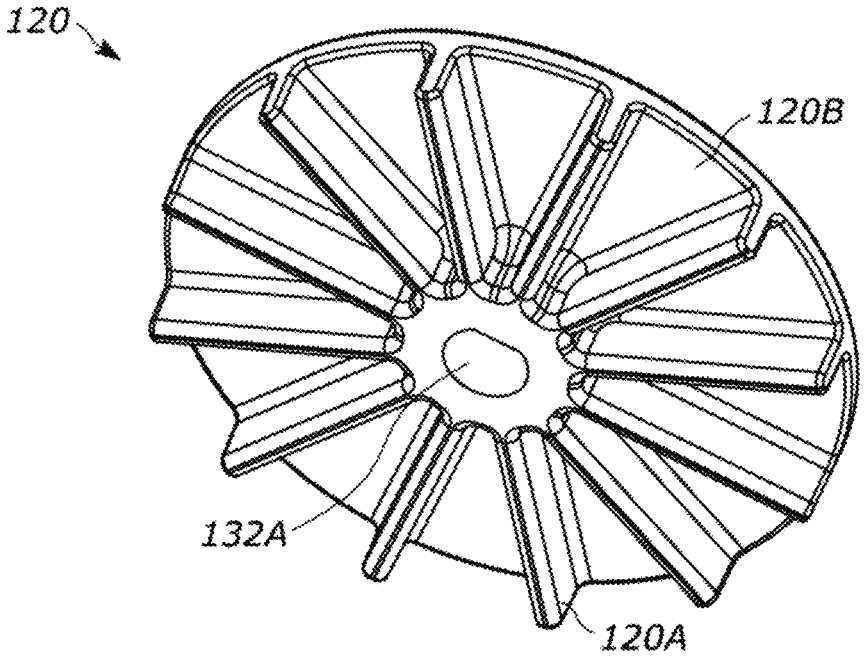
FIG. 2B is a bottom perspective view of the impeller of the pump of FIG. 1A.

Referring to FIG. 1D, a section view of the protrusion 106 is shown. The protrusion 106 houses the float switch 111, which includes a float switch base 111A, float switch arm 111B, and a first float detection member 111C, which is connected to the float switch base 111A by the float switch arm 111B. The protrusion 106 further houses a second float detection member 134 in the second channel 104B, which is immediately adjacent channel 104A. The second float detection member 134 is operably connected to the control circuitry 103B. With reference to FIGS. 1D and 3A-4A, a float switch cover plate 136 is shown which removably attaches to a portion of the top portion 122 of the fluid chamber 110. The bottom portion of the protrusion 106 may include teeth 107A that the float switch cover plate 136 contacts when attached to the protrusion 106. Fluid may enter the cavity 105 formed by the protrusion 106 through gaps 107B in the teeth 107A which may aid in filtering debris from entering the cavity 105 of the protrusion 106.

The control circuitry 103B may control the motor 115A based in part on the position of the float switch 111, which is contained in the protrusion 106 in the pump housing 102. The motor 115A turns the shaft 115B. The impeller 120 has a hub 132 that connects to the shaft 115B such that the motor 115A rotates the impeller 120. In the embodiment shown, the bottom surface 120B has a plurality of vortex vanes 120A, while the top surface 120C of the impeller 120 has no vanes (see FIGS. 2A-2B).

In the present embodiment, water enters the protrusion cavity 105 through the inlet gaps 107B. The float switch 111, which may be made of a metallic material filled with air, rises as the water level within the cavity 105 rises. As the water level rises, the trigger activation member 111C of the float switch 111 moves upward and enters the channel 104A. Once the water level has risen to a certain threshold height, the trigger activation member 111C is aligned with the trigger member 134 disposed within the second channel 104B of the pump 100. Once the trigger activation member 111C is aligned with the trigger member 134, the control circuitry 103B determines, based on a signal from the trigger member 103B detecting the alignment of the trigger activation member 111C, that the water level has reached a threshold level. In this example, the trigger member 134 begins in an "Off" configuration, wherein the control circuitry 103B determines that power is not needed and the power supply 103A provides no power to the motor 115A. When the trigger activation member 111C is aligned with the trigger member 134, the control circuitry 103B determines that the water level has reached a threshold height and to run the pump 100 or turn the pump 100 "On." The control circuitry 103B causes power to be provided from the power supply 103A to the motor 115A.

In some embodiments, the float detection trigger member 134 may be a Hall effect sensor, wherein the float trigger activation member 111C is a magnet and the float detection trigger member 134 detects the presence of the magnetic field produced by the float trigger activation member 111C when aligned with the float detection trigger member 134. Once the float detection trigger member 134 moves from an "Off" configuration to an "On" configuration, the control circuitry 103B determines that power is needed and causes power to be provided from the power supply 103A to the motor 115A, turning the pump 100 "On."

Still, in other embodiments, the float switch 111 may include a lever arm that floats up through the channel 104A and closes the circuit to turn the pump 100 on. The float switch 111 may further comprise a capacitive sensor.

While it is referred to as a float switch 111, it should be understood that the float switch 111 is used to refer to a float body and associated mechanical and/or electrical components for operating the switch and/or detecting the presence of water in the pump 100.

Figure 7:
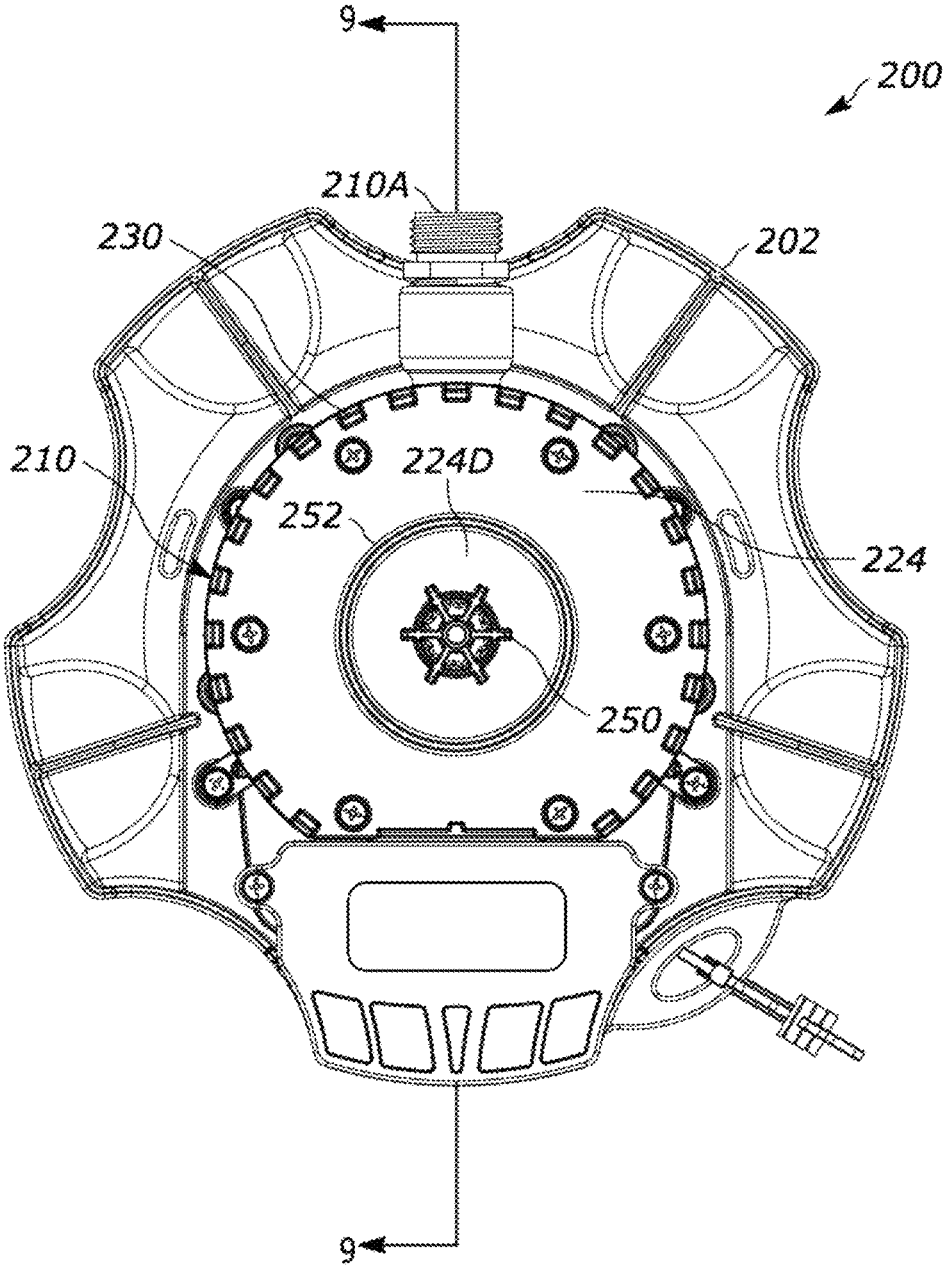
FIG. 7 is a bottom plan view of a pump according to a second embodiment.
Figure 8A:
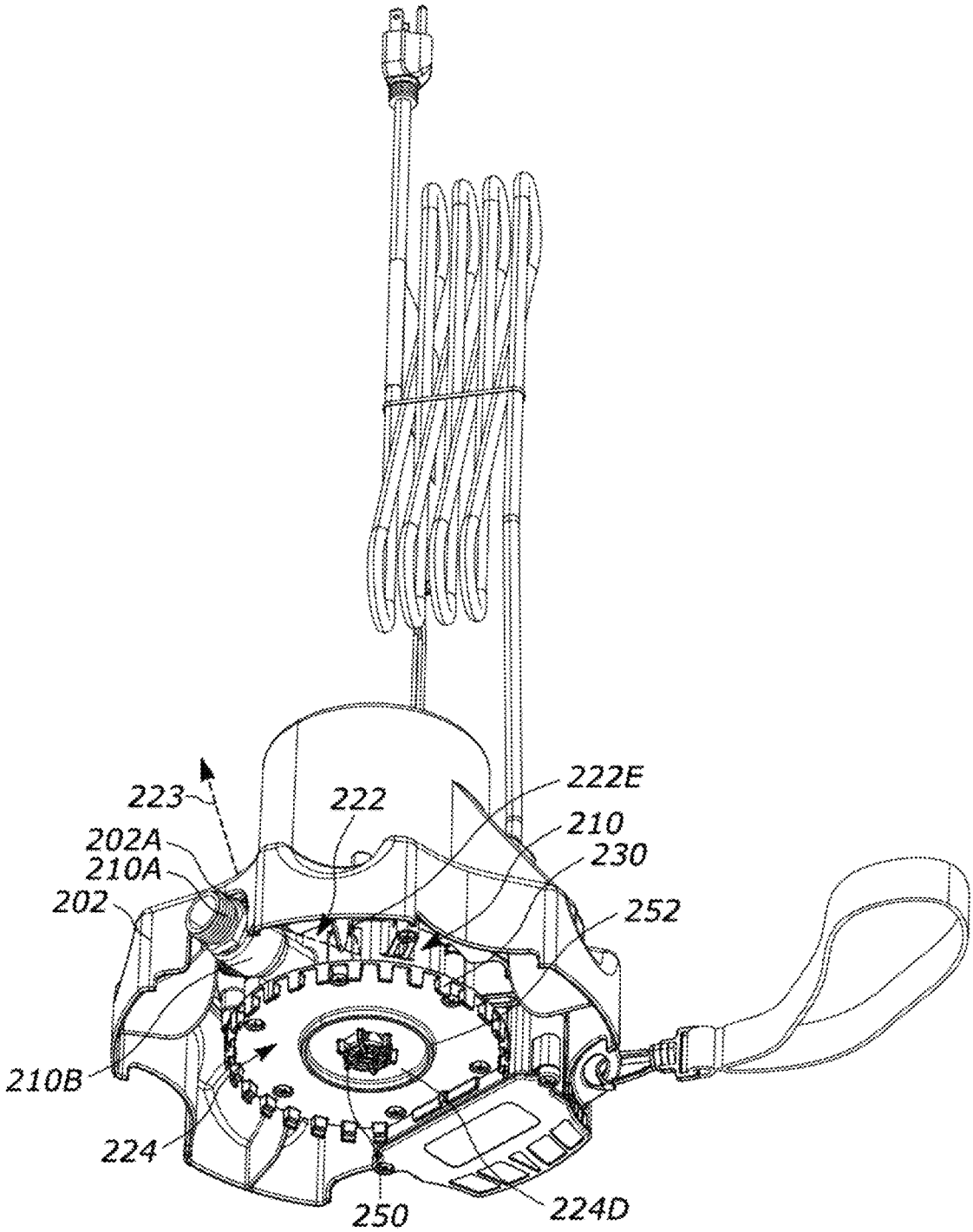
FIG. 8A is a bottom perspective view of the pump of FIG. 7.
Figure 8B:
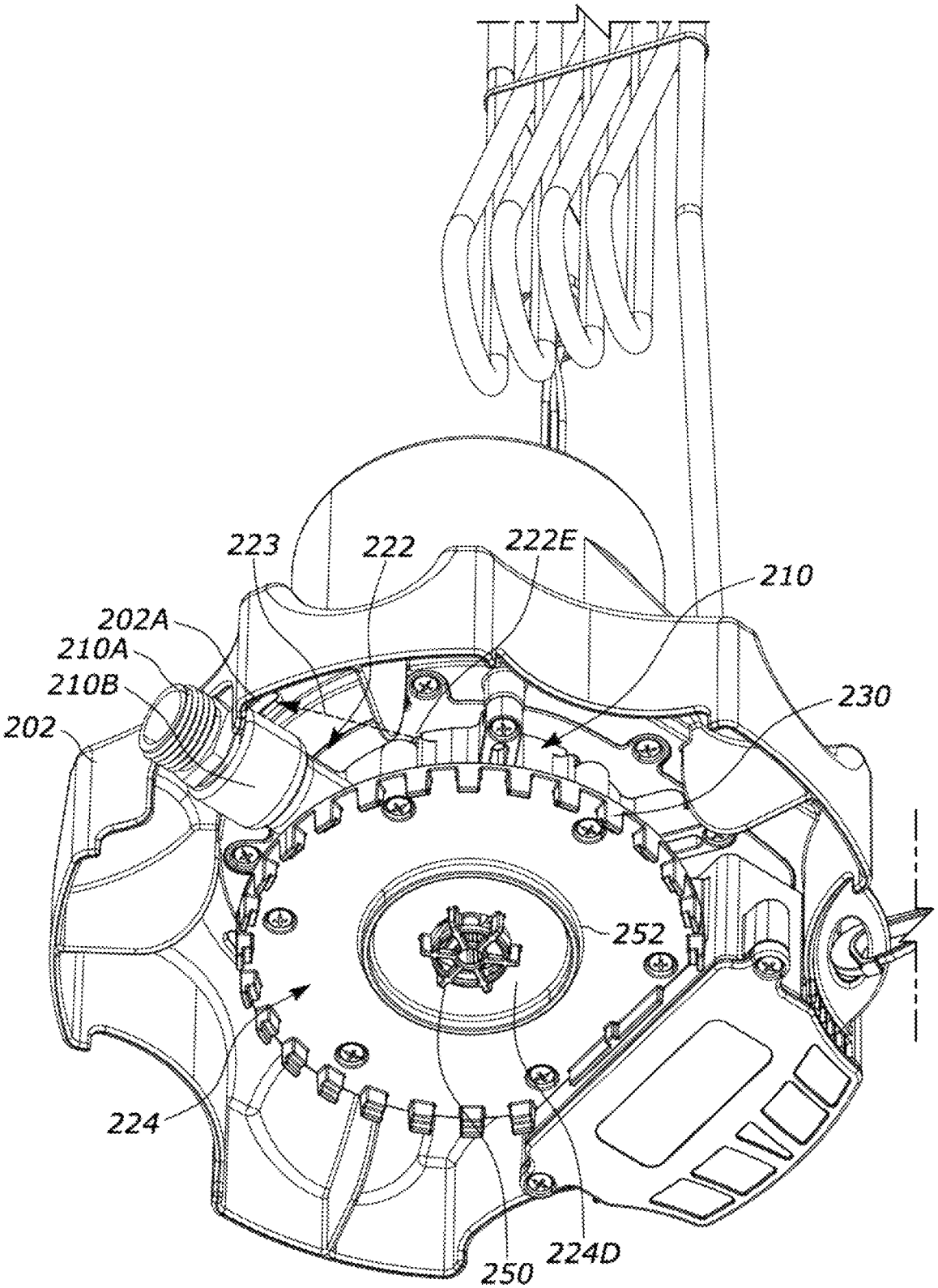
FIG. 8B is a bottom perspective view of a portion of the pump of FIG. 7.
Figure 9:
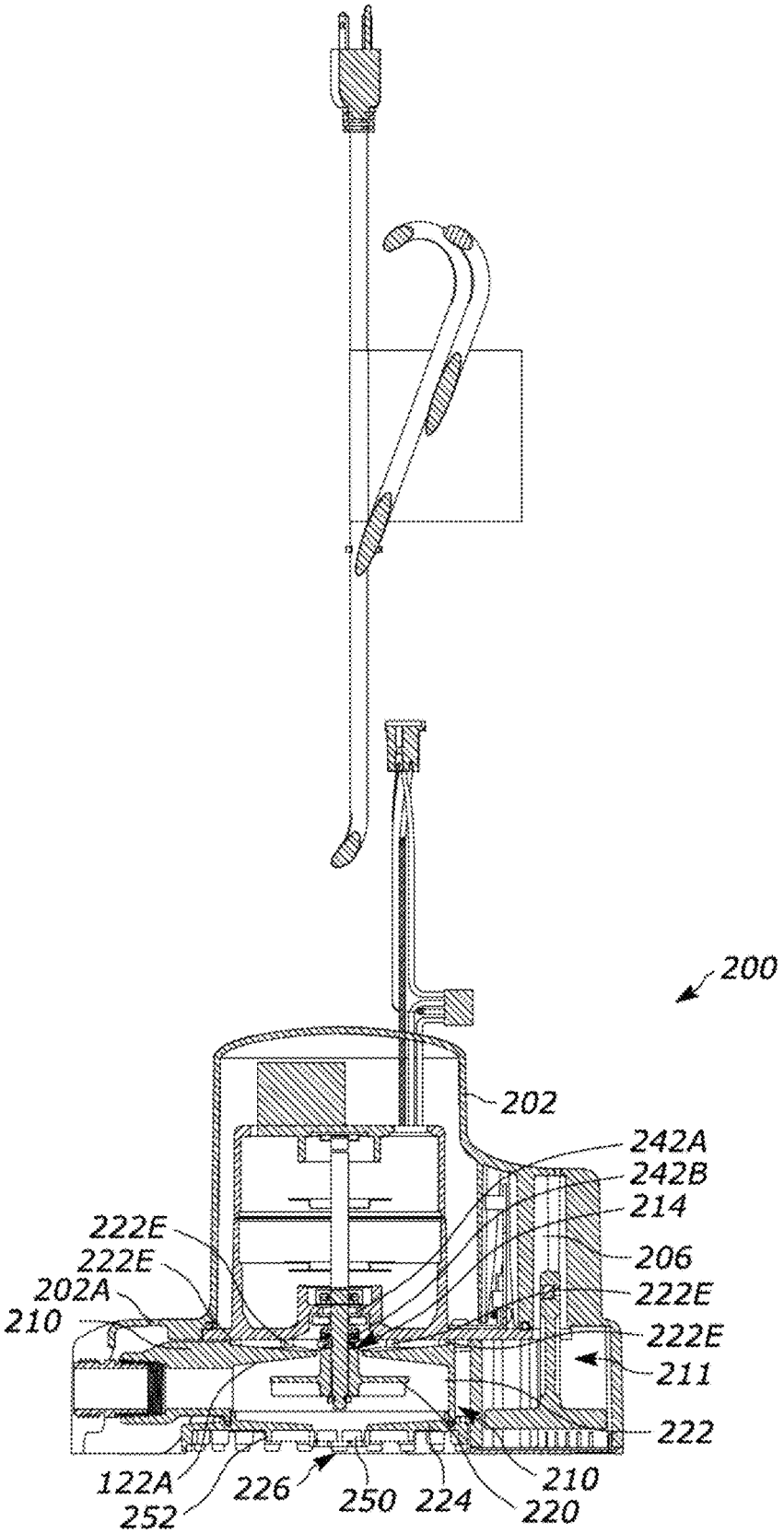
FIG. 9 is a cross-section view of the pump of FIG. 6 taken along lines 9-9 of FIG. 7.

With reference to FIGS. 7-9, a pump 200 according to a second embodiment is shown. Pump 200 is similar in many respects to the pump 100 shown and discussed in regard to FIGS. 1-6, the differences of which are highlighted in the following discussion. Features of pump 200 that correspond to features of pump 100 are shown with the prefix of the reference numeral changed from "1" to "2." For example, a feature shown as "102" with regard to pump 100 will be shown as "202" with regard to pump 200.

In contrast to pump 100 described above, pump 200 does not include a cover plate attached to the bottom portion 224 of the fluid chamber 210 and covering the inlet 226. Instead, the ring of teeth 230 of the bottom portion 224 of the fluid chamber 210 directly contact a surface on which the pump 200 is placed. When the pump 200 is placed on a substantially flat surface such that the teeth 230 engage the surface, the teeth 230 may filter the fluid entering the pump 200 via the inlet 126. The teeth 230 may aid to prevent debris and other particles larger than the gap between the teeth 230 from passing through to the inlet 226 of the fluid chamber 210.

As shown in FIG. 7, a filter cage 250 is positioned on the bottom surface 224D of the bottom portion 224 of the fluid chamber 210 and covering the opening forming the inlet 226. The filter cage 250 has a diameter that is at least slightly larger than the diameter of the inlet 226, such that it covers the inlet 226 and filters the fluid entering the fluid chamber 210 via the inlet 226. The filter cage 250 inhibits debris larger than the openings in the filter cage from entering the fluid chamber 210.

The pump 200 may also include a protruding filter wall, such as an annular wall 252, that protrudes form the bottom surface 224D of the bottom portion 224 of the fluid chamber 210. The annular wall 252 may aid to restrict debris and other particles from reaching the inlet 226. For instance, when the pump 200 is placed on a surface, the annular wall 252 may extend toward the surface and create a small gap between the annular wall 252 and the surface that restricts particles larger than the gap from reaching the inlet 216. In other embodiments, the annular wall 252 is a second ring of teeth that aids in filtering the fluid drawn into the fluid chamber 210. In a pool cover pump application, this wall may help prevent leaves and sticks that were small enough to get through the outer ring filter of the housing from traveling further toward the central inlet and final inner inlet filter.

It should be understood that numerous embodiments have been described herein and further are contemplated. For example, in one form a pump is disclosed herein having a pump housing defining an enclosure within which at least a portion of a motor is disposed, the motor at least partially disposed within the pump housing enclosure and having a motor shaft upon which an impeller is positioned. The pump further includes a fluid housing defining a cavity within which the impeller is positioned to move fluid from an inlet of the fluid housing through an outlet of the fluid housing. The pump further has at least one vent for venting air to prevent pump air locks from occurring. The at least one vent is comprised of an inner sloped wall on an inner surface of the fluid housing that slopes toward an opening defined in the fluid housing within which the motor shaft is disposed. The at least one vent includes a recess located on an outer surface of the fluid housing through which air in the fluid housing escapes. The recess may be a plurality of recesses located in an annular wall extending from the outer surface of the fluid housing and the at least one vent may include an outer sloped wall on the outer surface of the fluid housing that directs air to the plurality of recesses located on the annular wall extending from the outer surface of the fluid housing. The at least one vent may include at least one vent opening located in the pump housing through which air passing from the cavity of the fluid housing, along the inner sloped wall and outer sloped wall of the fluid housing, and through the recesses in the annular wall extending from the outer surface of the fluid housing exits. The motor has a sealing plate that abuts the fluid housing and defines a sealing cavity within which a seal is disposed to prevent fluid from entering the motor from the fluid housing. The sealing cavity has a first portion of a first diameter and a second portion with a second diameter smaller than the first diameter and the seal comprises a first seal fit within the first portion with first diameter and a second seal fit within the second portion with the second diameter. The first and second seals define coaxial center openings through which the motor shaft is fit.

In another form, a pump is disclosed herein having a pump housing defining an enclosure within which at least a portion of a motor is disposed, and a fluid level sensor is disposed. The motor is at least partially disposed within the pump housing enclosure and has a motor shaft upon which an impeller is positioned. The pump has fluid housing defining a cavity within which the impeller is positioned to move fluid from an inlet of the fluid housing through an outlet of the fluid housing. The pump has a fluid level sensor disposed within the pump housing. The fluid level sensor is a float switch having a float and a corresponding float bracket within which the float moves. The float bracket is formed integrally with the fluid housing for guiding vertical movement of the float of the float switch between a low fluid level position and a high fluid level position where the float is at a lower position when in the low fluid level position and the float is at a higher position when in the high fluid level position. The integrally formed bracket has a U-shape with a central vertical wall and first and second side vertical walls extending from opposite ends of the central vertical wall, respectively, and at least one of the walls has a first structure for mating with a corresponding second structure on the float to guide the float between the low fluid level position and the high fluid level position.

While this detailed description describes various specific examples of pumps, it should be understood that numerous methods are contemplated herein. A person of ordinary skill in the art would recognize that these descriptions are sufficient to understand how to build and/or operate any of the pumps disclosed herein. Therefore, this description covers the methods of making or using the pumps and/or individual components of the pumps described. For example, methods of venting a pump to prevent air locks or vapor locks are disclosed herein. In other forms, methods of manufacturing a fluid chamber having a conical top surface are disclosed herein. In yet another form, methods of manufacturing a housing having channels for receiving a float switch are disclosed herein. In yet another form, methods of guiding movement of a float switch and methods of integrating a float switch into a pump are disclosed herein, etc. For example, in addition to the numerous impeller, fluid chamber and pump embodiments disclosed herein, there are also disclosed methods of manufacturing a fluid chamber having a conical shape, and a pump housing having an internal water-level sensing mechanism. In a preferred form, the pump will be provided with a fluid chamber having a conical-shaped top surface and a housing having a protrusion which contains an internal water level sensing mechanism, wherein the water sensing mechanism may take a variety of forms, including but not limited to a float switch, a Hall effect sensor, a capacitive sensor, or a purely mechanical sensor having a lever arm that opens and closes a circuit. For example, the channel housing the control circuitry and trigger may be perpendicular to the channel which receives the float switch. The trigger would be positioned at the top of the channel receiving the float switch, at the point where the two channels intersect. The float switch travels in its respective channel when water enters the inlet and the trigger activation member would make contact with the trigger, thus closing the switch and turning the pump on. The benefit of an internal float switch is that it may be convenient to have a float switch that is internal to the housing of the pump, as opposed to having a float switch that is bulky and external to the pump system.

Other methods disclosed herein include methods of manufacturing a fluid chamber having a generally conical top portion, methods of processing fluid through a pump/pump inlet/pump outlet, methods for efficient venting in a pump, methods for generating different fluid flow in, through, or via a pump, methods for manufacturing a pump having an internal float switch, and/or methods for detecting water levels.

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

What is claimed is:

1. A pump comprising:

a motor configured to rotate a shaft;

an impeller operably coupled to the shaft;

a fluid chamber housing the impeller, the fluid chamber having an inlet, a discharge in fluid communication with the inlet and an outlet in a top portion of the fluid chamber that fluidly connects the fluid chamber to a passage of the pump along which air is able to flow out of the pump to thereby vent air within the fluid chamber, wherein an interior surface of the top portion of the fluid chamber is shaped to direct air toward the outlet; and a pump housing containing the motor, the impeller, and the fluid chamber, the pump housing including vents extending through a surface thereof, the vents in fluid communication with the outlet of the fluid chamber, wherein the interior surface of the top portion of the fluid chamber is sloped upward and inwards toward the outlet, wherein the interior surface of the top portion of the fluid chamber has a frustoconical shape.

2. The pump of claim 1 wherein an exterior surface of the top portion of the fluid chamber is sloped downward toward the outlet.

3. The pump of claim 1 wherein the outlet is at an uppermost portion of the fluid chamber.

4. The pump of claim 1 wherein the shaft extends through the outlet in the fluid chamber.

5. The pump of claim 1 wherein the inlet is in a bottom surface of the fluid chamber and the discharge is in a sidewall of the fluid chamber.

6. The pump of claim 1 further comprising a pump housing containing the motor, the impeller, the fluid chamber, and a float.

7. The pump of claim 6 wherein the pump housing includes a first cavity for housing the float, the float configured to travel within the cavity in response to a change in a level of a fluid in which the pump is submerged.

8. A pump comprising:

a motor configured to rotate an impeller;

a fluid chamber housing the impeller, the fluid chamber having an inlet for drawing fluid into the fluid chamber and a discharge for expelling fluid from the fluid chamber, the fluid chamber having an at least partial ring of teeth protruding from a bottom surface thereof for filtering the fluid entering the inlet of the fluid chamber; and a plate configured to engage the ring of teeth such that fluid entering the fluid chamber via the inlet passes through spaces between the teeth of the ring of teeth, wherein each tooth of the ring of teeth include a stepped shoulder for engaging the plate.

9. The pump of claim 8 wherein the plate is attached to the fluid chamber via fasteners extending through the plate and the fluid chamber.

10. A pump comprising:

a pump housing;

a motor at least partially disposed within the pump housing and having a motor shaft;

an impeller positioned on the motor shaft;

a fluid housing defining a cavity within which the impeller is positioned to move fluid from an inlet of the fluid housing through a discharge of the fluid housing; and a fluid level sensor disposed within the pump housing, wherein the fluid level sensor is a float switch having a float and a corresponding float bracket within which the float moves, wherein the bracket is formed integrally with the fluid housing for guiding vertical movement of the float of the float switch between a low fluid level position and a high fluid level position, wherein the float is at a lower position when in the low fluid level position and wherein the float is at a higher position when in the high fluid level position, wherein the integral bracket has a U-shape with a central vertical wall and first and second side vertical walls extending from opposite ends of the central vertical wall, respectively, and at least one of the walls having a first structure for mating with a corresponding second structure on the float to guide the float between the low fluid level position and the high fluid level position.

* * * * *